United States Patent [19]

Stahlecker et al.

[11] 4,084,398

[45] Apr. 18, 1978

[54] MOBILE SERVICING ARRANGEMENT FOR OPEN-END SPINNING MACHINES

[76] Inventors: Fritz Stahlecker, Josef-Neidhart-Str. 18, 7341 Bad Uberkingen; Hans Stahlecker, Haldenstrasse 20, 7334 Sussen, both of Germany

[21] Appl. No.: 693,150

[22] Filed: Jun. 7, 1976

[30] Foreign Application Priority Data

Jun. 7, 1975 Germany ..... 2525560

[51] Int. Cl.[2] ..... D01H 13/22

[52] U.S. Cl. ..... 57/34 R; 57/53; 57/81

[58] Field of Search ..... 57/34 R, 53, 81; 73/159–160

[56] References Cited

U.S. PATENT DOCUMENTS

| | | | |
|---|---|---|---|
| T886,007 | 5/1971 | Harvey et al. | 73/160 |
| 3,303,698 | 2/1967 | Loepfe | 73/160 |
| 3,377,852 | 4/1968 | Leistra | 73/160 |
| 3,626,680 | 12/1971 | Whitney | 57/34 R |
| 3,810,352 | 5/1974 | Miyozaki et al. | 57/34 R |
| 3,850,025 | 11/1974 | Reufer et al. | 73/160 X |
| 3,950,926 | 4/1976 | Stahlecker | 57/34 R |

*Primary Examiner*—Richard C. Queisser
*Assistant Examiner*—Charles Gorenstein
*Attorney, Agent, or Firm*—Craig & Antonelli

[57] ABSTRACT

A servicing arrangement selectively displaceable along an open-end spinning machine which includes a number of individual spinning stations. At least one measuring head is arranged on the displaceable servicing means so as to selectively monitor the quality of the running thread or yarn at the individual spinning stations. A control apparatus is operatively associated with the measuring head and receives signals therefrom, whereby the control apparatus regulates elements for arresting a spinning operation at a spinning station and/or marks individual spinning stations and/or blocks a piecing operation at the spinning stations when the quality of the running thread or yarn at such stations is below a predetermined quality.

29 Claims, 4 Drawing Figures

22
21
24
23
15
16
32
25
26
14
31
10
13
30
12
28
11
29
7
1
3
8
9
27
2
5
4
17
18
19
20

MOBILE SERVICING ARRANGEMENT FOR OPEN-END SPINNING MACHINES

The present invention relates to a servicing arrangement and, more particularly, to a service unit movable along an open-end spinning machine and including a means for monitoring the thread at individual spinning stations of the spinning machine.

At each individual spinning station of an open-end spinning machine, it has been proposed to provide a thread monitoring sensor which monitors the presence of a spun thread and, in case of thread breakage, interrupts the feeding of the fibers and optionally calls for a servicing device to the affected spinning station. Additionally, in, for example, DOS 2,008,142, it has been proposed to accommodate detectors sensing the presence of a thread on a mobile servicing device with, for example, DAS 2,139,881 proposing to equip a servicing device of a ring spinning machine with a thread monitoring sensor which monitors the presence of the thread at the individual spinning stations with the servicing device itself containing additional thread monitoring sensors examining the operability of the unit.

One disadvantage of these proposals resides in the fact that, with the aid of the afore-mentioned devices, it is impossible to sense flaws in the yarn which do not necessarily lead to a thread breakage. This disadvantage is extremely significant in open-end spinning machines since periodic yarn flaws or thread faults occur frequently, leading in the thus-manufactured fabric to moire phenomena, whereby the fabric almost regularly must be rejected as defective. Furthermore, it is even very difficult to eliminate such thread flaws on spooling machines equipped with slub catchers, for the slub catchers presently employed normally do not respond to such minor differences in cross-section of the yarn or thread which later on lead to the moire phenomena.

Although it has been found that moire flaws invariably occur always at the same spinning stations, it is almost impossible under practical conditions to find these spinning stations without incurring considerable expenses.

To avoid the occurrence of the noted faults and flaws, it has been proposed to install at each individual spinning station a slub catcher which interrupts the spinning operation as soon as it determines an inadequate quality of the yarn or thread; however, a disadvantage of this proposal resides in the fact that the remaining slub catchers can only detect sites of extreme thickness or thinness of the yarn or thread, but such catchers do not exhibit the required sensitivity to determine differences in quality which could lead to a moire effect. Since the normal slub catchers involve quite a considerable expenditure, the costs of mounting an especially sensitive slub catcher at each spinning station will be intolerable under practical conditions.

Thread sensors responding to differences in the thread thickness in other type spinning machines have been proposed and, for example, in Swiss Pat. No. 551,923, an arrangement is provided wherein synthetic threads exiting from spinnerets are guided in each case through a slot of a capacitively operating sensor with the thus-determined signals then being stored in a data store and evaluated.

The aim underlying the present invention essentially resides in providing an arrangement having the capacity of monitoring the thread or yarn quality in an open-end spinning machine without having to incur intolerably high expenditures. For this purposes, provision is made according to the present invention whereby a servicing unit is displaceably mounted along an open-end spinning machine and includes a thread monitoring means having at least one measuring head selectively associated with a running thread, which measuring head functions to monitor the quality of the running thread and provides control signals to a control apparatus serving to control the operation of at least one of the spinning stations.

By virtue of the arrangement in accordance with the present invention, the expensive and complicated servicing units are installed in the mobile servicing device and need not be separately provided for each individual spinning station whereby the total expenditure can be maintained within reasonable limits. The mobile servicing device can be fashioned to operate automatically by incurring only minor additional costs and the duration of the thread or yarn control can be freely selected so that also periodically occurring thread or yarn flaws can be detected with certainty. Preferably, the measuring head is operatively connected in a manner similar to the connection disclosed in the "Uster" arrangement.

According to another feature of the present invention, means are provided for stopping or shutting down an individual spinning station upon the detection of a flaw in the thread or yarn with such means being responsive to and regulated by the control apparatus.

While in certain cases, the source of the poor quality thread or yarn can be eliminated by a cleaning step and a renewed piecing of the thread in the spinning station, especially periodic flaws are frequently caused by inadequacies which cannot be eliminated by cleaning or the like and, according to yet another advantageous feature of the present invention, means are provided for marking or identifying the individual spinning stations which with regularity produce a faulty thread or yarn, thereby inviting the attention of the operating personnel to the fact that a checkup and/or a servicing operation must be conducted at such spinning station.

In many instances, the individual spinning stations are equipped with means for providing a signal in case of a thread break resulting in a servicing device responding to such signal and effecting the piecing operation, optionally after a previous cleaning step. To prevent a servicing unit from effecting the piecing and optional cleaning operation, thereby rendering operative a spinning station producing a thread or yarn having an insufficient quality, in accordance with still yet another feature of the present invention, means are provided for blocking a piecing operation following a thread break at a spinning station.

To make it possible that either all spinning stations or a predetermined number of such stations are monitored in sufficiently brief time intervals, in accordance with a further advantageous feature of the present invention, a plurality of measuring heads are operatively connected to a common setting mechanism with the measuring heads actuating, by way of a common control apparatus, a corresponding number of means for stopping and/or identifying and/or blocking of a piecing operation at the individual spinning stations producing defective yarn or thread.

Accordingly, it is an object of the present invention to provide a mobile servicing arrangement for an open-end spinning machine which avoids the shortcomings and drawbacks encountered in the prior art.

A further object of the present invention resides in providing a mobile servicing arrangement for an open-end spinning machine which selectively monitors the thread or yarn quality and controls the operation of the spinning station or stations producing defective yarn or thread.

Still another object of the present invention resides in providing a mobile servicing arrangement for an open-end spinning machine, wherein the duration of the thread or yarn control can be freely selected.

A still further object of the present invention resides in providing a mobile servicing arrangement for an open-end spinning machine which identifies a spinning station or stations which regularly produce faulty yarn or thread and which prevents continued operation of such spinning stations.

A further object of the present invention resides in providing a control apparatus for an open-end spinning machine whereby it is possible, in a simple manner and without any great expenditure, to detect periodically occurring thread or yarn flaws and to locate the respective defective spinning stations which would be possible, if at all, only at extremely high costs.

These and other objects, features and advantages of the present invention will become more apparent from the following description when taken in connection with the accompanying drawing which shows, for the purposes of illustration only, several embodiments of a mobile servicing arrangement for an open-end spinning machine in accordance with the present invention, and wherein.

Figure 1:
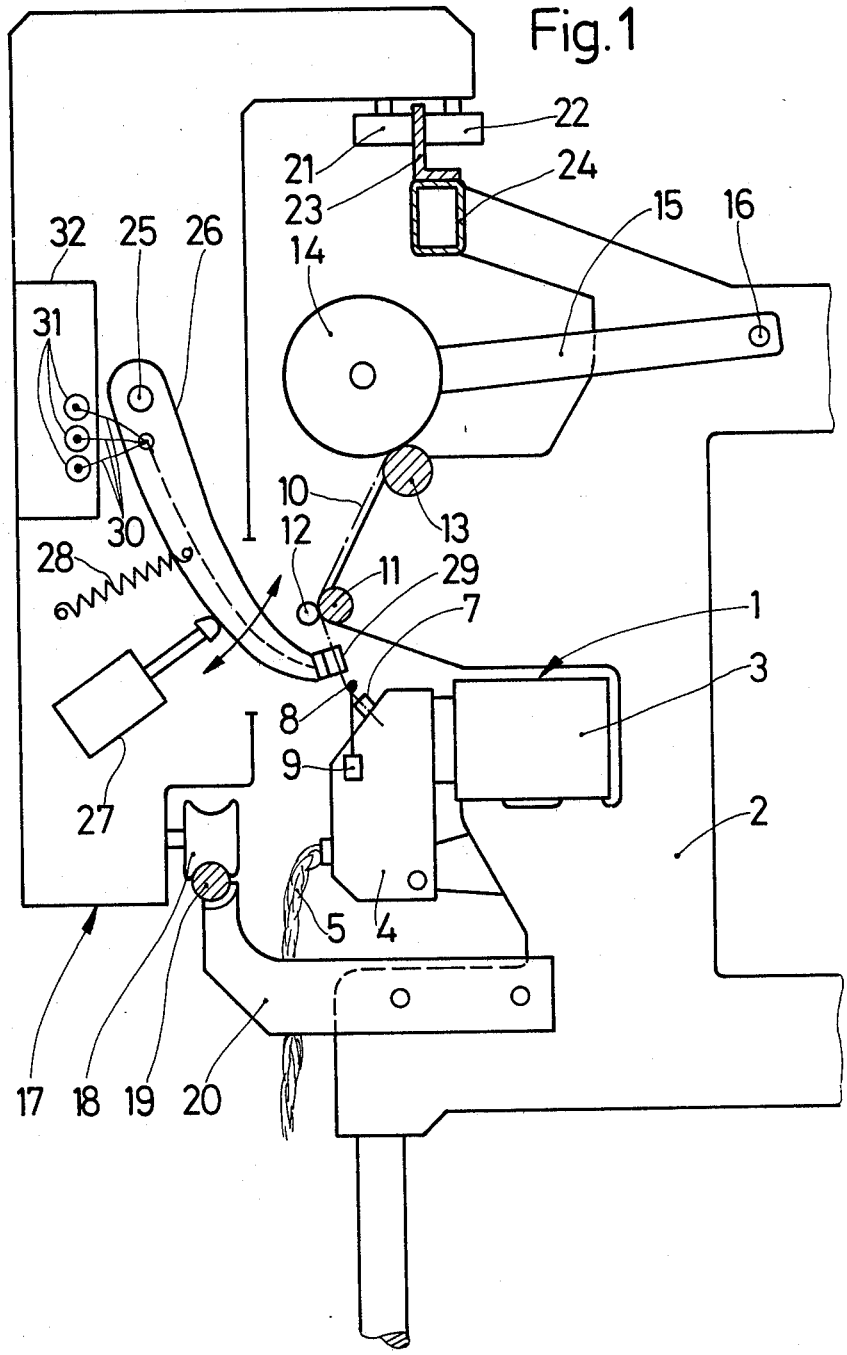
FIG. 1 is a vertical section through a portion of an open-end spinning machine having arranged thereat a servicing arrangement in accordance with a first embodiment of the present invention.

Referring now to the drawings, wherein like reference numerals are used throughout the various views to designate like parts and, more particularly to FIG. 1, according to this figure, a portion of one side of an open-end spinning machine is illustrated, which machine is equipped bilaterally with spinning stations generally designated by the reference numeral 1 arranged in a mirror-image symmetry. The spinning stations 1 are arranged and supported on a machine frame 2 and each station contains essentially a housing 3 with a drive mechanism (not shown) and a bearing for a spinning turbine with a housing 4 fashioned as a cover for a feeding and opening device. A sliver 5 is fed to the feeding and opening device and, after being broken up into individual fibers and after the spinning step in the spinning turbine, the sliver 5 is withdrawn as a spun thread or yarn 10 (in dot-dash lines) by way of a thread take-off duct 7, at the mouth of which is arranged a thread monitor 8. The take-off operation of the thread 10 is effected by way of a pair of take-off rolls 11, 12 followed by a bobbin 14 driven by a winding roll 13. A holder 15, pivotable about the axle or pin 16, mounts the bobbin 14 so as to permit a lifting of the bobbin off the winding roll 13.

At least one mobile servicing device generally designated by the reference numeral 17 is arranged at the open-end spinning machine and serves, in a conventional manner, for effecting, whenever required, a cleaning step and/or a piecing step and/or a bobbin change for bobbin 14 at a particular spinning station 1. A single mobile servicing unit can be arranged at the spinning machine which can execute all of these functions or, of course, it is also possible to provide a separate service unit for each of these functions, which separate unit is moved independently of the others.

The servicing device 17 is provided with at least two rollers 18 so as to displaceably guide the device along a rail 19 attached to a machine frame 2 by means of supports 20. The rail 19 is arranged at the machine frame 2 such that it extends in the longitudinal direction of the spinning machine so that the service device 17 may be selectively brought into alignment with the respective individual spinning stations 1.

A drive mechanism (not shown) is operatively connected with at least one of the rollers 18 to selectively displace the service device 17 along the rail 19. An additional track rail 24 is provided on which a guide rail 23 supports runners 21 and 22 of the servicing device 17 whereby horizontal forces exerted by the servicing device 17 are safely absorbed.

The servicing device 17 includes a control unit 32 for detecting and evaluating thread or yarn flaws, especially those flaws which occur periodically at the spinning station 1. For this purpose, a lever or arm 26, pivotable about the axle 25, is provided and is held in its rest position by a tension spring 28. From the rest position, the lever 26 is urged or displaced into its operative position by an actuating arrangement such as, for example, a piston-type solenoid 27. At least one measuring head 29 is arranged at the pivoting arm 26 and is provided with a slot through which the thread or yarn 10 to be tested is guided. Wires or lines 30 extend through the pivoting arm 26, which is hollow on the inside, to the control apparatus 32 whereby flaw detection signals are transmitted from said measuring head 29 where they are connected with measuring points 31 through the wires 30 to the control apparatus 32.

It is within the contemplation of the present invention to arrange the control apparatus 32 at a separately movable servicing unit rather than mount such apparatus at the servicing device 17.

Figure 2:
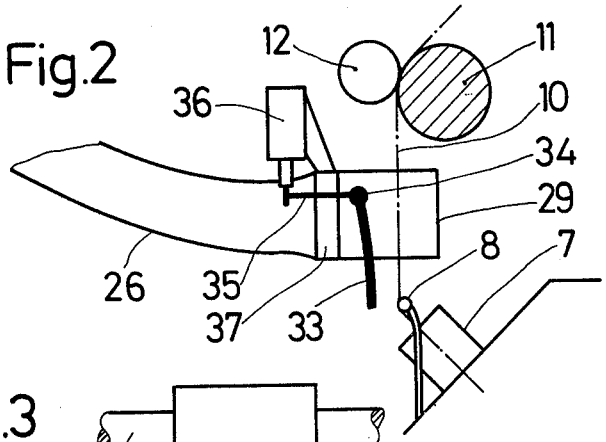
FIG. 2 is a fragmentary view, on an enlarged scale, of a portion of the measuring head of FIG. 1.

As shown most clearly in FIG. 2, lever or arm 26 has attached at a free end thereof the slotted measuring head 29 with the thread 10 running through the measuring head 29 and being deflected at the thread monitor 8 as well as at the pair of take-off rolls 11, 12. A stopping mechanism is mounted at the lever 26 and includes a double lever 33, 35, selectively actuable by a solenoid 36, so as to be pivotable about the axle 34. The lever portion 33 selectively actuates the thread monitor 8 and associated switch 9, if required, whereby the spinning process can conventionally be interrupted by stopping the feed of the sliver 5. For example, thread monitor 8 can control an electric switch which in the mid position of monitor 8 maintains delivery of yarn and which interrupts the yarn delivery when moved to the right by lever 33 or to the left by means of a spring in the event of a yarn breakage.

Figure 3:
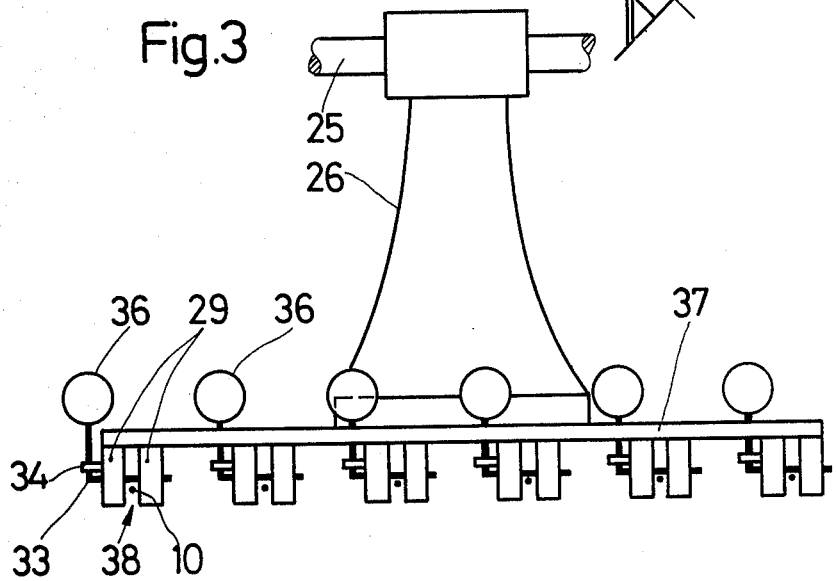
FIG. 3 is a top plan view of a further embodiment of a servicing arrangement in accordance with the present invention.

As shown in FIG. 3, a crossbar 37 may be provided for mounting at least six measuring heads 29, whereby the threads 10 running at six separate spinning stations of the spinning machine can be controlled simultaneously. Each of these measuring heads 29 has a slot generally designated by the reference numeral 38 through which the particular thread 10 is guided, as well as a stopping mechanism whereby the lever portion 33 of the double lever 33, 35 engages the thread monitor and associated switch, if required, in the manner described above.

Figure 4:
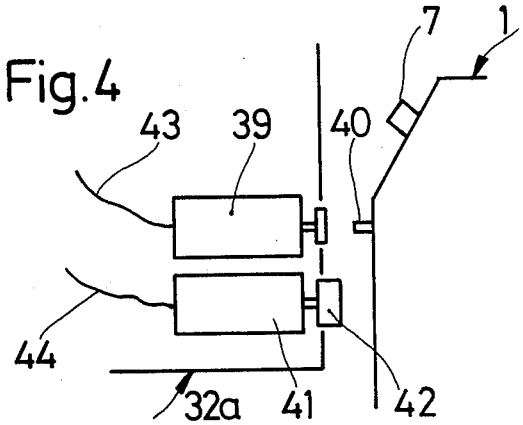
FIG. 4 is a schematic illustration of a portion of the control apparatus of the servicing arrangement in accordance with the present invention.

FIG. 4 provides a schematic illustration of a portion of a control apparatus 32*a* located in opposition to and in alignment with a spinning station 1. From the measuring unit (not shown) of the control apparatus 32*a*, a wire or line 44 is provided for supplying an actuating signal to an actuating arrangement such as, for example, a piston-type solenoid 41. The actuating arrangement includes a piston 42 which can press a label or provide some other identifying mark at the spinning unit 1 in case of a detected disturbance or flaw in the thread or yarn. Additionally or alternatively, a further actuating arrangement 39 can be provided which is likewise coupled to the measuring apparatus 32*a* by way of a line 43 whereby upon actuation, the plunger element is displaced, thereby inwardly pressing a sensor or signal generator 40 arranged at the spinning station 1. The sensor or signal generator 40 extends, in a conventional manner, out of the spinning station 1 upon the occurrence of a thread break at the station. By actuating the sensor or signal generator 40, the control apparatus 32*a* can prevent a possible following servicing device from repairing a thread break at the defective spinning station 1 and restarting from the operation of such spinning station prior to a determination as to the cause of the production of defective yarn or thread.

While we have shown and described several embodiments in accordance with the present invention, it is understood that the same is not limited thereto, but is susceptible of numerous changes and modifications as known to those skilled in the art, and we therefor do not wish to be limited to the details shown and described herein, but intend to cover all such changes and modifications as are encompassed by the scope of the appended claims.

We claim:

1. Servicing apparatus arrangement for an open-end spinning machine comprising:

a mobile servicing carriage, means for moving said servicing carriage along a predetermined guide path to respective servicing positions adjacent respective spinning stations of the spinning machine, thread quality monitoring means carried by said servicing carriage, said monitoring means including at least one thread quality measuring head means and adjusting means for adjusting the position of said measuring head means to selectively detect the quality of the thread being produced at a respective spinning station, and control signal means for providing a control signal to a spinning machine control means in response to detection of quality defects in thread running by said measuring head means.

2. Servicing apparatus arrangement according to claim 1, wherein a plurality of measuring head means are provided and arranged so as to be selectively aligned with an equal number of adjacent spinning stations, and a common setting means for displacing said measuring head means from a rest position to a thread detecting position in response to a signal from the control means is provided.

3. An arrangement according to claim 1, further comprising means regulated by the control means for stopping a spinning operation of a spinning station in response to a detection of a predetermined quality of the running thread by said measuring head means.

4. An arrangement according to claim 3, further comprising means operatively associated with the control means for marking a spinning station at which said measuring head means detects the predetermined quality of running thread.

5. An arrangement according to claim 4, wherein said marking means includes means for attaching a label at the spinning station.

6. An arrangement according to claim 4, including a servicing means for effecting a piecing operation at the individual spinning stations, further comprising means operatively associated with the control means for preventing a piecing operation at a spinning station at which said measuring head means detects the predetermined quality of running thread.

7. An arrangement according to claim 5, wherein means are provided at each spinning station for generating a signal for at least one of indicating a necessity of service of the spinning unit and calling the servicing unit to such spinning station, and wherein means are provided and operatively associated with the control means for shutting of said signal generating means in response to said measuring head means detecting the predetermined quality of the running thread at the spinning station.

8. An arrangement according to claim 3, further comprising means for severing the thread at a spinning station in response to a detection of the predetermined quality of the running thread by said measuring head means.

9. An arrangement according to claim 3, wherein said stopping means includes means for interrupting a thread fiber feed to the spinning station.

10. An arrangement according to claim 1, further comprising means operatively associated with the control means for marking a spinning station at which said measuring head means detects the predetermined quality of running thread.

11. An arrangement according to claim 10, including a servicing means for effecting a piecing operation at the individual spinning stations, further comprising means operatively associated with the control means for preventing a piecing operation at a spinning station at which said measuring head means detects the predetermined quality of running thread.

12. An arrangement according to claim 1, including a servicing unit for effecting at least one of a cleaning operation, piecing operation and bobbin change, and wherein the control means, said measuring head means and said service unit are fashioned as a single structural unit.

13. A arrangement according to claim 12, wherein a means is provided for setting said measuring head means from a rest position to a running thread detecting position including a lever, one end of which is pivotally mounted at the service unit with said measuring head means being arranged at the other end of said lever.

14. An arrangement according to claim 13, wherein said measuring head means includes a slot means encompassing and guiding the running thread being monitored.

15. An arrangement according to claim 1, including a servicing means for effecting a piecing operation at the individual spinning stations, further comprising means operatively associated with the control means for preventing a piecing operation at a spinning station at which said measuring head means detects the predetermined quality of running thread.

16. An arrangement according to claim 1, wherein said measuring head means includes a servicing unit for effecting at least one of a cleaning operation, piecing operation and bobbin change, and wherein the control means, said measuring head means and said service unit are fashioned as a single structural unit.

17. A servicing arrangement displaceable along an open-end spinning machine having a plurality of individual spinning stations, each of which produces a running thread, the arrangement comprising: means for monitoring the thread at each spinning station including at least one measuring head means associated with the running thread for selectively detecting the quality of the running thread and providing a control signal to a spinning machine control means, and wherein said measuring head means includes a measuring head and a pivotally mounted lever means for displacing said measuring head from a rest position to a detecting position.

18. A servicing arrangement displaceable along an open-end spinning machine having a plurality of individual spinning stations, each of which produces a running thread, the arrangement comprising: means for monitoring the thread at each spinning station including at least one measuring head means associated with the running thread for selectively detecting the quality of the running thread and providing a control signal to a spinning machine control means, and wherein a plurality of measuring head means are provided and arranged so as to be selectively aligned with an equal number of adjacent spinning stations, and a common setting means for displacing said measuring head means from a rest position to a thread detecting position in response to a signal from the control means is provided.

19. An arrangement according to claim 18, further comprising means at each measuring head means regulated by said control means for stopping a spinning operation of an associated spinning station in response to a detection of a predetermined quality of running thread by the measuring head means.

20. An arrangement according to claim 19, further comprising means at each measuring head means and operatively associated with the control means for marking an associated spinning station at which the measuring head means detects the predetermined quality of running thread.

21. An arrangement according to claim 20, including a servicing means for effecting a piecing operation at the individual spinning stations, further comprising means operatively associated with each measuring head means for preventing a piecing operation at an associated spinning station at which the measuring head means detects the predetermined quality of running thread.

22. An arrangement according to claim 21, wherein the control means, plurality of measuring heads and service unit are fashioned as a single structural unit.

23. An arrangement according to claim 22, wherein the service unit includes means for effecting at least one of a cleaning operation and a bobbin change.

24. An arrangement according to claim 22, wherein said common setting means includes a lever, one end of which is pivotally mounted at the service unit, said plurality of measuring head means being arranged at a free end of said lever.

25. An arrangement according to claim 24, wherein each of said measuring head means includes a slot means encompassing and guiding the running thread being monitored.

26. An arrangement according to claim 21, wherein said marking means includes means for attaching a label at the associated spinning station.

27. An arrangement according to claim 26, wherein means are provided at each spinning station for generating a signal for at least one of indicating a necessity of service of the spinning unit and calling the servicing unit to such spinning station, and wherein means are provided and operatively associated with the control means for shutting off said signal generating means in response to said measuring head means detecting the predetermined quality of the running thread at the associated spinning station.

28. An arrangement according to claim 18, further comprising means at each measuring head means and operatively associated with the control means for marking an associated spinning station at which the measuring head means detects the predetermined quality of running thread.

29. An arrangement according to claim 28, including a servicing means for effecting a piecing operation at the individual spinning stations, further comprising means operatively associated with each measuring head means for preventing a piecing operation at an associated spinning station at which the measuring head means detects the predetermined quality of running thread.

* * * * *